US006128933A

United States Patent [19]

Mirshafiee et al.

[11] Patent Number: 6,128,933

[45] Date of Patent: Oct. 10, 2000

[54] ADJUSTABLE INTERCONNECTED LOCK

[75] Inventors: David Mirshafiee, Fountain Valley; Gary Bergen, Yorba Linda, both of Calif.

[73] Assignee: Emhart Inc., Newark, Del.

[21] Appl. No.: 09/496,153

[22] Filed: Feb. 1, 2000

Related U.S. Application Data

[62] Division of application No. 09/130,987, Aug. 7, 1998.

[51] Int. Cl.[7] ..... E05B 59/00

[52] U.S. Cl. ..... 70/107; 70/451; 70/461; 70/462; 292/39; 292/244; 292/DIG. 60

[58] Field of Search ..... 70/107–109, 451, 70/461, 462; 292/39, 244, DIG. 60

[56] References Cited

U.S. PATENT DOCUMENTS

| | | | |
|---|---|---|---|
| 897,686 | 9/1908 | Voight | 70/451 |
| 3,254,518 | 6/1966 | Tucker | 70/107 |
| 3,791,180 | 2/1974 | Doyle | 70/107 |
| 3,910,613 | 10/1975 | Nolin | 70/107 X |
| 3,999,789 | 12/1976 | Maurits et al. | 70/107 X |
| 4,129,019 | 12/1978 | Urdal | 70/107 |
| 4,276,760 | 7/1981 | Nolin | 70/107 |
| 4,838,053 | 6/1989 | Shen | 292/336.3 X |
| 4,979,767 | 12/1990 | Lin | 292/336.3 |
| 5,325,687 | 7/1994 | Lin | 70/107 |
| 5,457,975 | 10/1995 | Berger et al. | 70/370 |
| 5,496,082 | 3/1996 | Zuckerman | 292/336.3 |
| 5,513,505 | 5/1996 | Danes | 70/107 |
| 5,655,393 | 8/1997 | Kuo et al. | 70/107 |
| 5,657,653 | 8/1997 | Hensley et al. | 70/107 X |
| 5,713,612 | 2/1998 | Kajuch | 292/36 |
| 5,787,741 | 8/1998 | Shen | 70/107 |
| 5,810,402 | 9/1998 | Armstrong | 292/39 |

FOREIGN PATENT DOCUMENTS

| | | | |
|---|---|---|---|
| 2026582 | 12/1971 | Germany | 70/461 |

*Primary Examiner*—Lloyd A. Gall

[57] ABSTRACT

An adjustable interconnected lockset adapted to be secured to a door which includes a mounting plate assembly having a vertically extending mounting plate having an operator bracket proximate the bottom thereof with the operator bracket having screw receiving holes. The lockset also has an exterior operator assembly including internally threaded posts, first screw holes extending through the mounting plate and screws which extend through the mounting plate and threadedly engaging with the threaded posts to clamp the door between the exterior operator assembly and the mounting plate assembly. The mounting plate has a central opening extending vertically upwardly from a location proximate the operator bracket and defining mounting plate side panels on either side thereof and the mounting plate assembly further has a dead bolt bracket which includes a central door engaging portion, a pair of opposed side portions adapted to engage the mounting plate side panels, and screw receiving holes. An exterior dead bolt assembly includes internally threaded posts and second screws extend through dead bolt bracket screw receiving holes and threadedly engage with the exterior dead bolt internally threaded posts to clamp the door between the exterior dead bolt assembly and the mounting plate assembly.

19 Claims, 1 Drawing Sheet

ADJUSTABLE INTERCONNECTED LOCK

CROSS REFERENCE TO RELATED APPLICATION

This is a divisional of U.S. application Ser. No. 09/130,987 filed Aug. 7, 1998.

BACKGROUND OF THE INVENTION

The present invention relates to locks which have an upper dead bolt (auxiliary lock) and a lower lock which are interconnected. The interconnection is to provide a panic feature, i.e., when the operator (the knob or lever) of the interior lower lock is turned, the upper dead bolt will be automatically released.

U.S. Ser. No. 08/694,978, filed Aug. 9, 1996, now U.S. Pat. No. 5,810,402 discloses an adjustable interconnected lock which enables interconnection of an exterior assembly that has one spacing between the dead bolt and the thumb piece and an interior assembly that has a different spacing between the turn button and the interior operator.

OBJECT OF THE INVENTION

It is an object of the present invention to provide an adjustable interconnected lock which is more user friendly than prior art designs.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE PREFERRED EMBODIMENT

Figure 1:
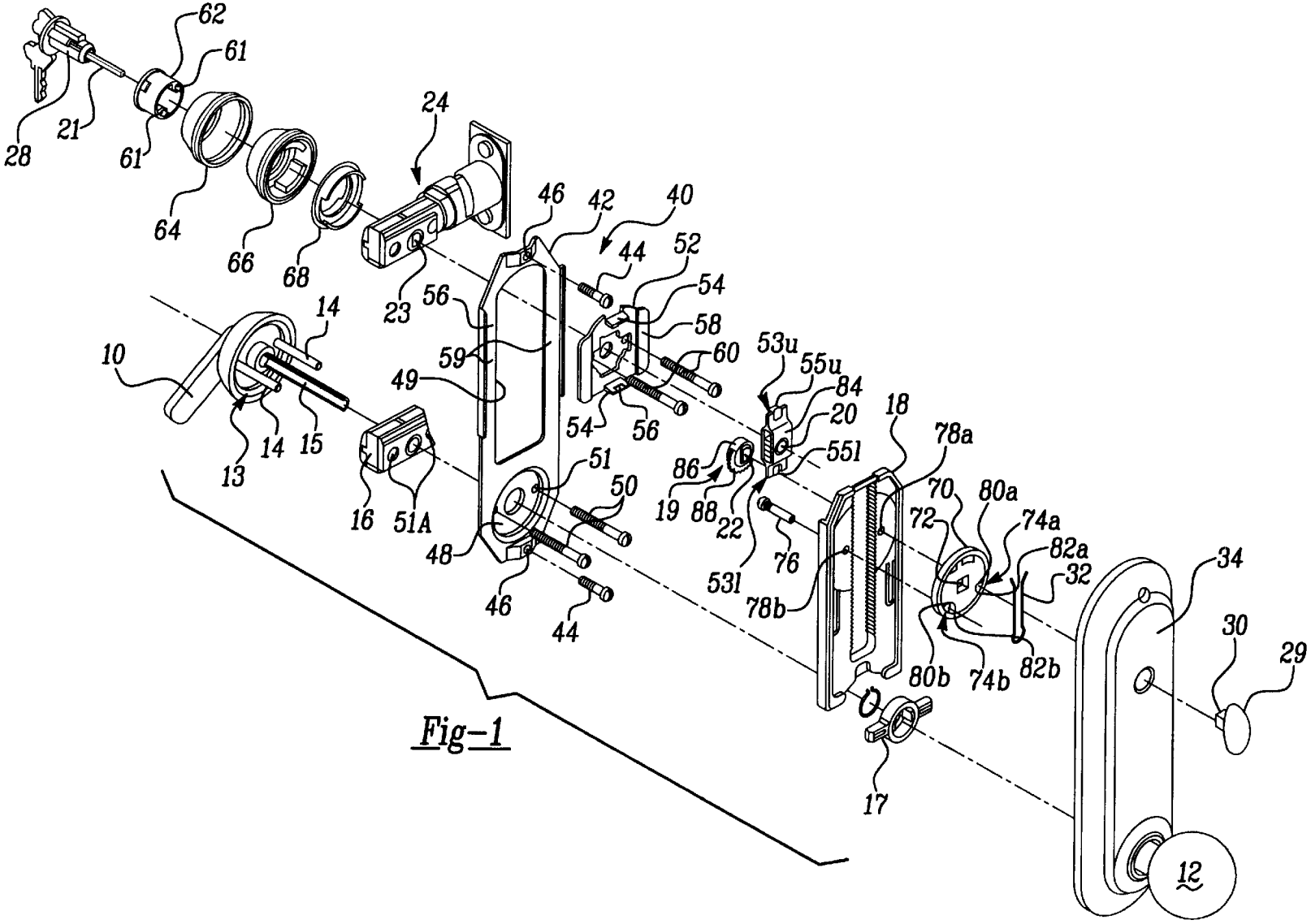
FIG. 1 is an exploded oblique view of an interconnected lock made in accordance with the teachings of the present invention.

When a door (not shown) is unlocked, the exterior operator 10 (here a lever) and the interior operator 12 (here a knob) operate together and when the door is locked the exterior operator can not be turned but the interior operator is free to turn. The structure which allows the operators to operate in this fashion is conventional and accordingly most is omitted from this description for purposes of clarity (U.S. Pat. Nos. 5,317,889 and 5,496,082 disclose such details and are incorporated by reference herein). The exterior operator assembly, which includes the lever 10, the liner 13 which has two posts 14 which are internally threaded at their ends, and a half round assembly 15, is shown as is the latch 16 which is operated by the half round assembly.

The turning of an operator, which is free to turn, rotates a lower axis cam 17 which elevates a rack 18 to drive a pinion 19 located within a housing 20. A D-shaped spindle 21, which is received by a D-shaped opening 22 in the pinion and by a D-shaped opening 23 in a dead latch assembly 24, operates the dead latch assembly 24 drawing the dead bolt back to its withdrawn position when the pinion is rotated through a selected angle (by turning an operator from its neutral position through that angle). The D-shaped spindle interconnects a key or motor operated cylinder assembly 28 at the front of the door with a turn button 29 on the interior. The turn button has a square section 30 which cooperates with a spring 32 which is captured in suitable supports (not shown) on the inner face of the rose 34 to maintain the turn button at either of two 90° related open and closed orientations (detent orientations).

To achieve adjustability to accommodate different spacings between the upper axis defined by the turn button and the key cylinder and the lower axis defined by the interior and exterior operators, a two piece mounting plate assembly 40 is utilized. One piece, the mounting plate 42, is secured to the interior surface of the door (not shown) by screws 44 which pass through suitable holes 46 in the mounting plate. The mounting plate is conventionally a solid plate including dead bolt and operator brackets at either end. Here the mounting plate only includes an exterior operator bracket 48 at its lower end which is located within the door through hole and has a central opening 49 which extends vertically from a location above the exterior operator bracket to a location short of the top of the mounting plate. A pair of screws 50 pass through suitable holes 51 in the operator bracket, through holes 51A in the latch assembly and are threaded into the internally threaded liner posts 14 thereby securing the exterior operator to the door.

The second piece of the mounting plate assembly 40 is a reinforcing plate in the form of a slide 52 which supports the pinion housing 20. The housing 20, which is made of plastic, has a pair of upper vertically extending struts 53*u* and a pair of lower vertically extending struts 53*l* which locate the housing between upper and lower flanges 54 of the slide 52. Upper central strut 55*u* is slightly longer than and extends between the pair of upper struts 53*u*. Lower central strut 55*l* is slightly longer than and extends between the pair of lower struts 53*l*. Central struts 55*u*, 55*l* are received by suitable openings 56 in the flanges 54 to secure the housing 20 in place. The slide 52 is located anywhere along the vertically extending opening 49 where the upper axis door hole has been drilled to receive the D-shaped spindle 21 and is secured in position with the vertically extending opposed ears 58 of the slide clamped against the side panels 59 of the mounting plate by a pair of screws 60 which are received by internally threaded posts 61 on the dead bolt cylinder housing 62 (the rest of the dead bolt is defined by a cover 64, a liner 66 and a guard 68).

To effect vertical displacement of the rack with rotation of either the turn button or the key, an upper axis cam 70 having a square opening 72 is located on the square end 30 of the turn button so that it will turn with the turn button. This cam 70 has left hand and right hand control openings 74*a* and 74*b*, respectively, one of which will receive the non threaded end of a screw 76 which is threadedly inserted into the corresponding left hand or right hand hole 78*a* and 78*b*, respectively, defined in the sides of the rack. These control openings are configured so that the screw will engage the top surface 80*a* or 80*b* of the respective right and left hand control openings 74*a* and 74*b* when the turn button is in the locked position. As the turn button is rotated to unlock the door, the upper axis cam will accordingly be rotated such that the bottom surface 82*a* or 82*b* of the right and left hand control openings 74*a* and 74*b* engage screw 76 to drive the screw to raise the rack 18. As the rack rises, the meshed engagement of the pinion 19 with the rack teeth causes the pinion and spindle 21 to rotate and move the dead bolt latch assembly to its withdrawn position. The rest of the right and left hand control openings 74*a* and 74*b* are configured so that the screw will be engaging the respective bottom most surface 82*a* or 82*b* when the turn button is at the unlocked position so that when the turn button is again rotated to advance the latch bolt, rotation of the control cam will simultaneously occur.

To switch the adjustable interconnected lock from one hand to the other, such as from the left hand configuration shown in FIG. 1 to right hand operation, the pinion housing 20 is removed and reversed from the first position illustrated to a second position relative to the slide wherein the pinion housing face 84 faces slide 52 and the rack screw is removed from left hand control opening 74*b* and left hand hole 78*b* and inserted into the right hand rack hole 78*a* so that it will be received by the right hand control opening 74*a*. As is illustrated, the pinion 19 includes a smooth circumferential section 86 and a toothed circumferential section 88. The toothed section is sized to allow rotation of the pinion to a released position wherein the pinion teeth do not engage the rack teeth whereupon the pinion may be easily removed from the rack and the pinion housing reversed as described above.

We claim:

1. An adjustable interconnected lockset adapted to be secured to a door comprising:

a lower latch movable between an engaged position and a disengaged position, said lower latch including a lower operator coupled to said lower latch to move said lower latch from said engaged position toward said disengaged position, said lower latch defining a lower axis;

an upper latch movable between an actuated position and a retracted position, said upper latch including an upper axis, an internal upper operator, and an external upper operator, said upper axis and said lower axis defining an axis spacing therebetween;

a mounting assembly including a mounting plate and a reinforcing plate, said mounting plate having a mounting opening with an upper end and a lower end and a lower operator passage aligned with said lower axis, said reinforcing plate having an upper axis passage, said reinforcing plate being selectively positionable in said mounting opening between said upper and lower ends and connectable to said mounting plate to define an adjustable center distance between said lower operator passage and said upper axis passage to accommodate different axis spacings;

a rack coupled to said mounting plate for movement relative thereto, said rack having a rack opening and rack teeth;

a pinion coupled for rotation with one of the external and internal upper operators, said pinion disposed in said rack opening and coupled to said reinforcing plate for rotation relative thereto, said pinion having pinion teeth positionable in meshed engagement with said rack teeth; and an upper axis cam coupled for rotation with the other of the external and internal upper operators, said upper axis cam coupled to said rack to displace said rack relative to said mounting plate when said upper axis cam is rotated.

2. The lockset of claim 1 further including a pin, wherein said rack further includes a first coupler passage, and wherein said upper axis cam includes a first control opening, said pin disposed in said first coupler passage and said first control opening to operationally couple said rack to said upper axis cam.

3. The lockset of claim 2 wherein said rack further includes a second coupler passage and said upper axis cam includes a second control opening, said pin being selectively disposable in said first coupler passage and said first control opening to couple said rack to said upper axis cam in a first coupling orientation and in said second coupler passage and said second control opening to couple said rack to said upper axis cam in a second orientation.

4. The lockset of claim 3 further including a pinion housing rotatably supporting said pinion, said pinion housing and said reinforcing plate having fasteners connecting said pinion housing to said reinforcing plate in one of a first position and a second position, said lockset operating in a right hand mode when said pinion housing is coupled to said reinforcing plate in said first position and said pin is disposed in said first coupler passage and said first control opening and in a left hand mode when said pinion housing is coupled to said reinforcing plate in said second position and said pin is disposed in said second coupler passage and said control opening.

5. The lockset of claim 4 wherein said pinion housing includes a strut and said reinforcing plate includes a flange, said strut and flange defining said fasteners.

6. The lockset of claim 5 wherein said rack teeth include a first set of rack teeth and a second set of rack teeth, said rack opening being between said first and second sets of rack teeth, said pinion having a circumferential surface having a toothed segment and a toothless segment, said toothed segment engaging said first set of rack teeth when said lockset is in said right hand mode, said toothed segment engaging said second set of rack teeth when said lockset is in said left hand mode.

7. The lockset of claim 6 wherein said pinion is rotatable relative to said rack to a released position wherein said toothed segment of said pinion is out of engagement with said first and second sets of rack teeth.

8. The lockset of claim 1 wherein said upper axis includes an upper internal axis and an upper external axis and wherein said upper internal axis is coaxial with said upper external axis.

9. The lockset of claim 1 wherein said upper axis includes an upper internal axis and an upper external axis and wherein said upper internal axis is not coaxial with said upper external axis.

10. The lockset of claim 1 wherein said reinforcing plate includes vertically extending ears, wherein said mounting plate includes side panels, and wherein said lockset further includes a fastener clamping said ears against said side panels to couple said reinforcing plate to said mounting plate.

11. The lockset of claim 10 wherein said upper latch includes an internally threaded post, said reinforcement plate includes an aperture, said fastener is a screw disposed in said aperture and threadedly engaging said internally threaded post.

12. An adjustable interconnected lockset adapted to be secured to a door comprising:

a lower latch having a lower operator to move said lower latch between an engaged position and a disengaged position;

an upper latch having an internal upper operator and an external upper operator to move said upper latch between an actuated position and a retracted position;

a mounting assembly including a reinforcing plate and a mounting plate coupled to said reinforcing plate;

a rack coupled to said mounting plate for movement relative thereto, said rack having a first set of rack teeth, a second set of rack teeth, and a rack opening being between said first and second sets of rack teeth;

a pinion assembly including a pinion housing and a pinion coupled to said pinion housing for rotation relative thereto and coupled for rotation with one of the external and internal upper operators, said pinion housing and said reinforcing plate having fasteners connecting said pinion housing to said reinforcing plate in one of a first position and a second position, said pinion having teeth engaging said first set of rack teeth when said pinion housing is in said first position, said pinion teeth engaging said second set of rack teeth when said pinion housing is in said second position; and an upper axis cam coupled for rotation with the other of the external and internal upper operators, said upper axis cam coupled to said rack to displace said rack relative to said mounting plate when said upper axis cam is rotated.

13. The lockset of claim 12 further including a pin, wherein said rack further includes a first coupler passage, and wherein said upper axis cam includes a first control opening, said pin being disposable in said first coupler passage and said first control opening to operationally couple said rack to said upper axis cam.

14. The lockset of claim 13 wherein said rack further includes a second coupler passage and said upper axis cam includes a second control opening, said pin being selectively disposable in said first coupler passage and said first control opening to operatively couple said rack to said upper axis cam in a first orientation and in said second coupler passage and said second control opening to operationally couple said rack to said upper axis cam in a second orientation.

15. The lockset of claim 14 wherein said lockset operates in a right hand mode when said pinion housing is in said first position and said pin is disposed in said first coupler passage and said first control opening and in a left hand mode when said pinion housing is in said second position and said pin is disposed in said second coupler passage and said second control opening.

16. The lockset of claim 15 wherein said pinion housing includes a strut and said reinforcing plate includes a flange, said strut and flange defining said fasteners.

17. The lockset of claim 15 wherein said pinion includes a circumferential surface having a toothed segment and a toothless segment, said toothed segment engaging said first set of rack teeth when said lockset is in said right hand mode, said toothed segment engaging said second set of rack teeth when said lockset is in said left hand mode.

18. The lockset of claim 17 wherein said pinion is rotatable relative to said rack to a released position wherein said toothed segment of said pinion is out of engagement with said first and second sets of rack teeth.

19. The lockset of claim 12 wherein said lower latch includes a lower axis, said upper latch includes an upper axis, said upper axis and said lower axis define an axis spacing therebetween, and wherein said mounting plate includes a mounting opening with an upper end and a lower end and a lower operator passage aligned with said lower axis, said reinforcing plate having an upper axis passage, said reinforcing plate being selectively positionable in said mounting opening between said upper and lower ends and connectable to said mounting plate to define an adjustable center distance between said lower operator passage and said upper axis passage to accommodate different axis spacings.

* * * * *